US009653247B2

(12) United States Patent
Tang et al.

(10) Patent No.: US 9,653,247 B2
(45) **Date of Patent: *May 16, 2017**

(54) X-RAY APPARATUS AND A CT DEVICE HAVING THE SAME

(71) Applicants: NUCTECH COMPANY LIMITED, Beijing (CN); TSINGHUA UNIVERSITY, Beijing (CN)

(72) Inventors: Huaping Tang, Beijing (CN); Chuanxiang Tang, Beijing (CN); Huaibi Chen, Beijing (CN); Wenhui Huang, Beijing (CN); Huayi Zhang, Beijing (CN); Shuxin Zheng, Beijing (CN); Jinsheng Liu, Beijing (CN)

(73) Assignees: Nuctech Company Limited, Beijing (CN); Tsinghua University, Beijing (CN)

( * ) Notice: Subject to any disclaimer, the term of this patent is extended or adjusted under 35 U.S.C. 154(b) by 195 days.

This patent is subject to a terminal disclaimer.

(21) Appl. No.: 14/490,516

(22) Filed: Sep. 18, 2014

(65) Prior Publication Data

US 2015/0078509 A1 Mar. 19, 2015

(30) Foreign Application Priority Data

Sep. 18, 2013 (CN) ..... 2013 1 0427174

(51) Int. Cl.
*H01J 35/06* (2006.01)
*H01J 35/02* (2006.01)
(Continued)

(52) U.S. Cl.
CPC ..... *H01J 35/025* (2013.01); *G21K 1/087* (2013.01); *H01J 35/02* (2013.01); *H01J 35/045* (2013.01);
(Continued)

(58) Field of Classification Search
CPC ..... A61B 6/032; A61B 6/035; A61B 6/4007; A61B 6/4014; A61B 6/4021;
(Continued)

(56) References Cited

U.S. PATENT DOCUMENTS 3,962,583 A 6/1976 Holland et al.
2003/0072407 A1* 4/2003 Mihara ..... A61B 6/032 378/4
(Continued)

FOREIGN PATENT DOCUMENTS

CN 102222594 A 10/2011
CN 102299036 A 12/2011
(Continued)

*Primary Examiner* — Jurie Yun
(74) *Attorney, Agent, or Firm* — McDermott Will & Emery LLP

(57) ABSTRACT

A two dimensional array distributed x-ray apparatus of this disclosure includes: a vacuum box which is sealed at its periphery, where the interior thereof is high vacuum; a plurality of electron transmitting units arranged in one plane in a two dimensional array on the wall of the vacuum box; an anode having targets corresponding to the plurality electron transmitting unit arranged in parallel with the plane of the plurality of electron transmitting units in the vacuum box; a power supply and control system having a high voltage power supply connected to the anode, a filament power supply connected to each of the plurality of the electron transmitting units, and a grid-controlled apparatus connected to each of the plurality of electron transmitting units; and a control system for controlling each power supply.

13 Claims, 5 Drawing Sheets

(51) Int. Cl.

| | |
|---|---|
| ***G21K 1/087*** | (2006.01) |
| ***H01J 35/14*** | (2006.01) |
| ***H01J 35/04*** | (2006.01) |
| ***H01J 35/10*** | (2006.01) |

(52) U.S. Cl.
CPC ..... *H01J 35/06* (2013.01); *H01J 35/10* (2013.01); *H01J 35/14* (2013.01); *H01J 2235/062* (2013.01); *H01J 2235/068* (2013.01); *H01J 2235/086* (2013.01); *H01J 2235/087* (2013.01)

(58) Field of Classification Search
CPC ..... A61B 6/4028; H01J 35/02; H01J 35/04; H01J 35/045; H01J 35/06; H01J 35/065; H01J 35/08; H01J 35/14; H01J 35/16; H01J 35/12; H01J 2235/06; H01J 2235/062; H01J 2235/068; H01J 2235/08; H01J 2235/083; H01J 2235/086; H05G 1/52; H05G 1/04; H05G 1/06; H05G 1/08; H05G 1/085; H05G 1/00; H05G 1/02; H05G 1/025; H05G 1/10
USPC ..... 378/4, 9, 10, 121, 122, 123, 124, 134, 378/136, 137, 138
See application file for complete search history.

(56) References Cited

U.S. PATENT DOCUMENTS

| | | | | |
|---|---|---|---|---|
| 2005/0025283 | A1 | 2/2005 | Wilson et al. | |
| 2010/0189223 | A1 | 7/2010 | Eaton et al. | |
| 2011/0075802 | A1 | 3/2011 | Beckmann et al. | |
| 2011/0286581 | A1* | 11/2011 | Sprenger ..... | H01J 35/04 378/113 |

FOREIGN PATENT DOCUMENTS

| | | | |
|---|---|---|---|
| CN | 202142495 | U | 2/2012 |
| CN | 102811544 | A | 12/2012 |
| CN | 102870189 | A | 1/2013 |
| CN | 203178216 | U | 9/2013 |
| CN | 203563254 | U | 4/2014 |
| CN | 203590580 | U | 5/2014 |
| CN | 103901057 | A | 7/2014 |
| CN | 103903940 | A | 7/2014 |
| CN | 103903941 | A | 7/2014 |
| CN | 203734907 | U | 7/2014 |
| DE | 4425691 | A1 | 2/1996 |
| EP | 0657915 | A1 | 6/1995 |
| JP | 2001-357724 | | 12/2001 |

* cited by examiner

X-RAY APPARATUS AND A CT DEVICE HAVING THE SAME

TECHNICAL FIELD

The present application relates to an apparatus generating distributed x-ray, in particular to a two dimensional array distributed x-ray apparatus generating x-ray altering the position of focus in a predetermined order in a x-ray light source device by arranging a plurality of independent electron transmitting units in two dimensional and arranging multiple targets correspondingly on the anode and by cathode control or grid control and a CT device having the two dimensional array distributed x-ray apparatus.

BACKGROUND

In general, x-ray light source refers to a device generating x-ray which is usually composed of x-ray tube, power supply and control system, auxiliary apparatus for cooling and shielding etc. or the like. The core of the device is the x-ray tube. The X-ray tube usually consists of cathode, anode, glass or ceramic housing etc. The cathode is a directly-heated spiral tungsten filament. When in operation, it is heated to a high-temperature state by current, thus generating thermal-transmitted electronic beam current. The cathode is surrounded by a metal cover having a slit in the front end thereof and focusing the electrons. The anode is a tungsten target inlayed in the end surface of the copper billet. When in operation, a high pressure is applied between the cathode and anode. The electrons generated by the cathode move towards the anode under the effect of electric field and ram the surface of the target, thereby the x-ray is generated.

X-ray presents a wide range of applications in the fields of nondestructive detection, security check and medical diagnoses and treatment etc. In particular, the x-ray fluoroscopic imaging device utilizing the high penetrability of the x-ray plays a vital role in every aspect of people's daily lives. The early device of this type is a film flat fluoroscopic imaging device. Currently, the advanced technology is digital, multiple visual angles and high resolution stereoscopic imaging device, e.g. CT (computed tomography), being able to obtain three-dimensional graphs or slice image of high definition, which is an advanced application.

In the current CT device, the x-ray source and the detector need to move on the slip ring. In order to increase the speed of inspection, the moving speeds of x-ray source and the detector are normally high leading to a decreased overall reliability and stabilization. In addition, due to the limit of moving speed, the inspection speed of the CT is limited accordingly. Therefore, there is a need for the x-ray source generating multiple visual angles without displacing.

To address the problems of reliability, stabilization and inspection speed caused by the slip ring as well as the heat resistance problem of the anode target spot, there are methods provided in the available patent literature. For example, rotating target x-ray source can solve the overheat of the anode target to some extent. However, its structure is complex and the target spot generating x-ray is still a definite target spot position with respect to the overall x-ray source. For instance, in some technology, a plurality of dependent conventional x-ray sources are arranged closely in a periphery to replace the movement of x-ray source in order to realize multiple visual angles of a fixed x-ray source. Although multiple visual angles can be realized, the cost is high. In addition, the space between the target spots of different visual angles is big and the imaging quality (stereoscopic resolution) is quite poor. What's more, a light source generating distributed x-ray and the method thereof is disclosed in the patent literature 1 (U.S. Pat. No. 4,926,452), wherein the anode target has a large area remitting the overheat of the target and multiple visual angles could be produced since the position of target spot changes along the periphery. Although the patent literature 1 performs scanning deflection to the accelerated high-energy electron beam, there are still problems of difficult control, non-disjunction of target spots and poor repeatability. Anyway, it is still an effective way to generate distributed light sources. Moreover, the light sources generating distributed x-ray and methods thereof are proposed in the patent literature 2 (US20110075802) and patent literature 3 (WO2011/119629), wherein the anode target has a large area remitting the overheat of the target and multiple visual angles could be produced since the position of target spots are fixed dispersedly and are arranged in an array. In addition, CNTs (carbon nano tubes) are employed as cold cathodes and the cold cathodes are arranged in an array. The transmitting is controlled by utilizing the voltage between cathode and grid so as to control each cathode to emit electron in sequence and bombard the target spot on the anode in an order correspondingly, thus becoming the distributed x-ray source. However, there are disadvantages of complex manufacturing process and poor transmitting capability and short lifetime of carbon nano tubes.

SUMMARY

The present application is proposed to address the above-mentioned problems, the aim of which is to provide a two dimensional array distributed x-ray apparatus and a CT device having the same in which multiple visual angles can be generated without moving the light source. This contributes to simplify the structure, enhance the stability and reliability of the system, hence increasing the efficiency of inspection.

The present application provides a two dimensional array distributed x-ray apparatus, characterized in that, it comprises: a vacuum box which is sealed at its periphery, and the interior thereof is high vacuum; a plurality of electron transmitting units arranged in one plane in a two dimensional array on the wall of the vacuum box; an anode arranged in parallel with the plane of the plurality of electron transmitting units in the vacuum box; a power supply and control system having a high voltage power supply connected to the anode, a filament power supply connected to each of the plurality of the electron transmitting units, a grid-controlled apparatus connected to each of the plurality of electron transmitting units, a control system for controlling each power supply; wherein the anode comprises: an anode plate made of metal and parallel to the upper surface of the electron transmitting unit; a plurality of targets arranged on the anode plate and disposed corresponding to the positions of the electron transmitting unit, the bottom surface of the target is connected to the anode plate and the upper surface of the target has a predetermined angle with the anode plate.

In the two dimensional array distributed x-ray apparatus of this disclosure, the target is a frustum of a cone, or a quadrate platform, or multi-edge platform or other polygon protrusions or other irregular protrusion.

In the two dimensional array distributed x-ray apparatus of this disclosure, the target is a platform of circular column, or a platform of square column, or a platform of other polygon column.

In the two dimensional array distributed x-ray apparatus of this disclosure, the target is a spherical structure.

In the two dimensional array distributed x-ray apparatus of this disclosure, the upper surface of the target is a plane, or a slope, or a spherical surface or other irregular surface.

In the two dimensional array distributed x-ray apparatus of this disclosure, the electron transmitting unit has a filament; a cathode connected to the filament; an insulated support having opening and enclosing the filament and the cathode; a filament lead extending from both ends of the filament; a grid arranged above the cathode opposing the cathode; a connecting fastener connected to the insulated support; wherein, the electron transmitting unit is installed on the walls of the vacuum box forming a vacuum seal connection, the grid having: a grid frame which is made of metal and provided with opening in the center; a grid mesh which is made of metal and fixed at the position of the opening of the grid frame; a grid lead, extending from the grid frame; wherein, the filament lead connected to the filament power supply and the grid lead connected to the grid control means extend to the outside of the electron transmitting unit through the insulated support.

In the two dimensional array distributed x-ray apparatus of this disclosure, the connecting fastener is connected to the outer edge of the lower end of the insulated support, and the cathode end of the electron transmitting unit is located inside the vacuum box while the lead end of the electron transmitting unit is located outside the vacuum box.

In the two dimensional array distributed x-ray apparatus of this disclosure, the connecting fastener is connected to the upper end of the insulated support, and the electron transmitting unit is overall located outside the vacuum box.

In the two dimensional array distributed x-ray apparatus of this disclosure, the electron transmitting unit comprises: a flat grid composed of an insulated frame plate, a grid plate, a grid mesh and grid lead; an array of the cathodes composed of multiple cathodes structure arranged tightly, wherein each cathode structure is composed of a filament, a cathode connected to the filament, a filament lead extended from both ends of the filament and an insulated support enclosing the filament and the cathode, the grid plate is provided to the insulated frame plate and the grid mesh is disposed at the position of the opening on the grid plate, wherein the grid lead extends from the grid plate and the flat grid is located above the cathode array, and in the vertical direction, the center of the each grid mesh is coincided with the center of each cathode of the cathode array, wherein the flat grid and the cathode array are located in the vacuum box, and the filament lead and the grid lead extends to the outside of the vacuum box by the transition terminal of the filament lead and the transition terminal of the grid lead arranged on the wall of the vacuum box.

In the two dimensional array distributed x-ray apparatus of this disclosure, the vacuum box is made of glass or ceramic.

In the two dimensional array distributed x-ray apparatus of this disclosure, the vacuum box is made of metal material.

In the two dimensional array distributed x-ray apparatus of this disclosure, it further comprises: a high voltage power supply connecting means connecting the anode to the cable of the high voltage power supply and installed to the side wall of the vacuum box at the end adjacent to the anode, a filament power supply connecting means for connecting the filament to the filament power supply, a connecting means of grid-controlled apparatus for connecting the grid of the electron transmitting unit to the grid-controlled apparatus, a vacuum power supply included in the power supply and control system; a vacuum means installed on the side wall of the vacuum box maintaining high vacuum in the vacuum box utilizing the vacuum power supply.

In the two dimensional array distributed x-ray apparatus of this disclosure, the two dimensional array of the plurality of the electron transmitting unit extends in lines in both directions.

In the two dimensional array distributed x-ray apparatus of this disclosure, the two dimensional array of the plurality of the electron transmitting unit extends in an arc in one direction and in a segmented arc in the other direction.

In the two dimensional array distributed x-ray apparatus of this disclosure, the grid-controlled apparatus includes a controller, a negative high voltage module, a positive high voltage module and a plurality of high voltage switch elements, wherein each of the plurality of high voltage switch elements at least includes a control end, two input ends, an output end, and the withstand voltage between each end at least larger than the maximum voltage formed by the negative high voltage module and the positive high voltage module, the negative high voltage module provides a stable negative high voltage to one input end of each of the plurality of high voltage switch elements and the positive high voltage module provides a stable positive high voltage to the other input end of each of the plurality of high voltage switch elements, the controller independently control each of the plurality of high voltage switch elements, the grid-controlled apparatus further has a plurality of control signal output channels, one output end of the high voltage switch elements is connected to one of the control signal output channels.

The present application provides a CT device, characterized in that, the x-rays source used is the two dimensional array distributed x-ray apparatus as mentioned above.

According to the present application, provided is a two dimensional array distributed x-ray apparatus generating x-rays changing the focus position periodically in a predetermined sequence in a light source device. By employing the thermionic cathode, the electron transmitting unit of this disclosure has the advantages of large transmitting current and long service life. It is easy and flexible to control the operating state of each electron transmitting unit by grid control or cathode control. The overheat of the anode is remitted by employing the design of big anode thus forming a focusing effect of the target and reducing the cost. By the two dimensional array configuration of the electron transmitting unit and the corresponding targets, the x-rays are transmitted in parallel to the plane of the array. Observed from the direction along which the x-rays are transmitted, the spaces between the target spots are decreased and the density of the target spots is increased. The electron transmitting units can be in a flat two dimensional configuration, or in an arc two dimensional configuration, rendering the overall to be a linear distributed x-ray apparatus or an annular distributed x-ray apparatus, so as to have flexible applications.

Applying the two dimensional array distributed x-ray light source to the CT device, multiple visual angles can be generated without moving the light source, and therefore the movement of slip ring could be omitted. This contributes to simplify the structure, enhance the stability and reliability of the system, hence increasing the efficiency of inspection.

DETAILED DESCRIPTION OF THE PREFERRED EMBODIMENTS

Figure 1:
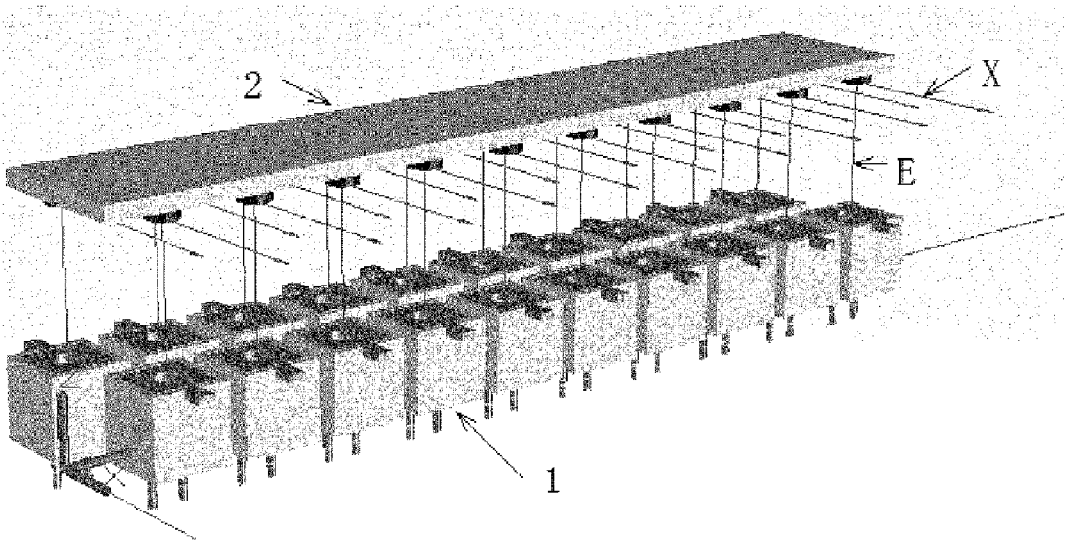
FIG. 1 depicts a schematic view of the main structure of the two dimensional distributed x-ray apparatus of the present application.

Hereinafter, detailed description of the present disclosure will be given in combination with the accompanying drawings.

As shown in FIG. 1-6, the two dimensional array distributed x-ray apparatus of the present application includes a plurality of electron transmitting units 1 (at least four, hereinafter also specifically referred to as electron transmitting unit 11*a*, 12*a*, 13*a*, 14*a* . . . electron transmitting unit 11*b*, 12*b*, 13*b*, 14*b* . . . ), an anode 2, a vacuum box 3, a high voltage power supply connecting means 4, a filament power supply connecting means 5, a connecting means of the grid-controlled apparatus 6, a vacuum means 8 and a power supply and control system 7. In addition, the electron transmitting unit 1 includes a filament 101, a cathode 102, a grid 103 etc. and the anode 2 includes an anode plate 201 and a plurality of targets 202 arranged on the anode plate corresponding to the electron transmitting units 1. The plurality of electron transmitting units 1 are arranged in a plane in a two dimensional array and are parallel to the plane of the anode plate 201. The electron transmitting units 1, the high voltage power supply connecting means 4, and the vacuum means 8 are installed on the wall of the vacuum box 3 and constitutes an overall seal structure together with the vacuum box 3. The anode 2 is installed inside the vacuum box.

FIG. 1 depicts a structure schematic view of the spatial arrangement of the electron transmitting unit 1 and anode 2 inside the two dimensional array distributed x-ray apparatus of the present application. The electron transmitting units 1 are arranged in a plane in two lines and the front line and the rear line of the electron transmitting units 1 are interlaced (c.f. FIG. 1). But the embodiments are not limited thereto. It is also possible that the front line and the rear line of the electron transmitting units are not interlaced. The anode 2 is located above the electron transmitting unit 1. The targets 202 on the anode 2 are in one-to-one correspondence to the electron transmitting units 1. The upper surface of the target 202 is directed to the electron transmitting units 1. The line from the center of the electron transmitting unit 1 to the center of the target 202 is perpendicular to the plane of the anode plate 201 and this line is also the moving path of the electron beam current E transmitted by the electron transmitting unit 1. The electrons bombard the target, thus generating x-rays. The transmitting direction of useful x-rays is parallel to the plane of the anode plate 201 and each useful x-ray is parallel to each other.

Figure 2:
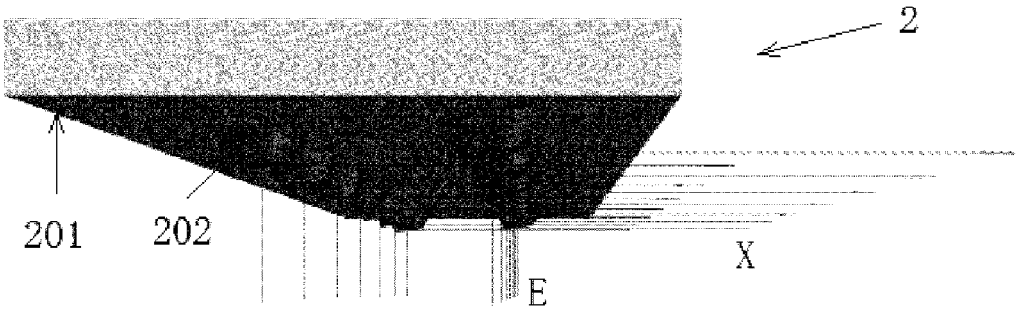
FIG. 2 depicts a bottom view of the structure of the anode in the two dimensional distributed x-ray apparatus in the present application.

FIG. 2 shows a structure of anode 2. The anode 2 includes an anode plate 201 and a plurality of targets 202 arranged in a two dimensional array. The anode plate 201 is a flat plate and is made of metal, preferable the heat resisting metal materials. The anode plate is completely parallel to the upper surface of the electron transmitting unit 1, i.e. the plane of the surface of the grid 103. When positive high voltage is applied on the anode 2, normally ranging from dozens of kv to hundreds of kv, typically e.g. 180 kv, the parallel high-voltage electric fields are therefore formed between the anode plate 201 and the electron transmitting unit 1. The target 202 is installed on the anode plate 201, the position of which is respectively arranged corresponding to the position of the electron transmitting unit 1. The surface of the target 202 is usually made of heat resisting heavy metal materials, such as tungsten or tungsten alloy. The target 202 is a structure of circular frustum, with a height of several mm, e.g. 3 mm. The bottom surface with relative large diameter is connected to the anode plate 201. The diameter of the upper surface is relative small, typically several mm, e.g. 2 mm. The upper surface is not parallel to the anode plate 201 and usually has a small angle ranging from several degrees to a degree no more than twenty such that the useful x-rays generated by the electron bombarding can be transmitted. All target 202 are arranged in a way that is consistent with the direction of the slope of the upper surface, that is, the transmitting directions of all useful x-rays are consistent. Such structure design of the target is equivalent to the small projection arose from the anode plate 201. Therefore, the partial distribution of electric field of the surface of the anode plate 201 is changed and an automatic focusing effect is obtained before the electron beam bombarding the target such that the target spot is small which contributes to enhance the equality of the image. In the design of the anode, the anode plate 201 is made of common metal and only the surface of the target 202 is tungsten or tungsten alloy, hence the cost is decreased.

Figure 3:
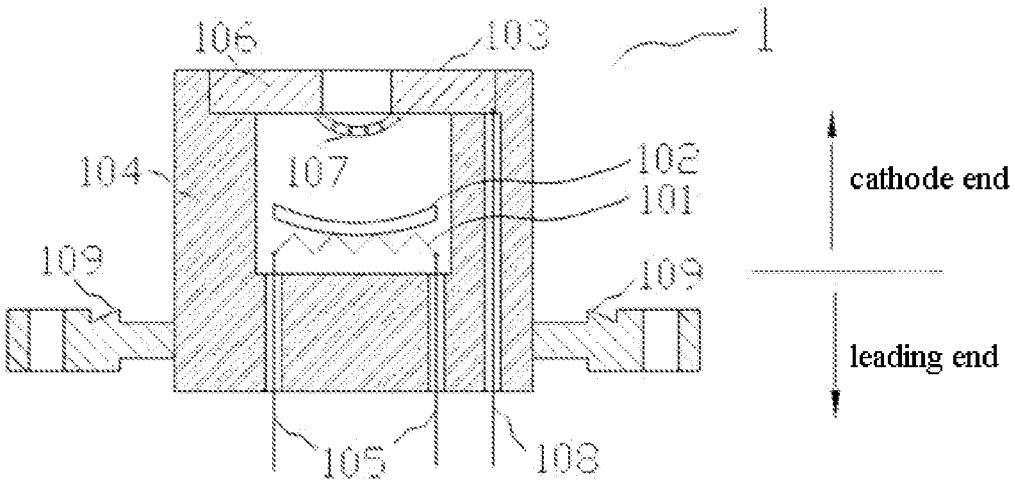
FIG. 3 depicts the schematic view of the structure of an electron transmitting unit in the present application.

A specific structure of electron transmitting unit 1 is shown in FIG. 3. The electron transmitting unit 1 includes a filament 101, a cathode 102, a grid 103, an insulated support 104, a filament lead 105, a connecting fastener 109 and the grid 103 is composed of a grid frame 106, a grid mesh 107, a grid lead 108. In FIG. 3, the position where the filament 101, cathode 102, grid 103 or the like are located is defined as the cathode end of the electron transmitting unit 1, and the position where the connecting fastener 109 is located is defined as the lead end of the electron transmitting unit 1. The cathode 102 is connected to the filament 101 which is usually made of tungsten filament. Cathode 102 is made of materials of strong capability to thermal transmit electron, such as baryta, scandate, lanthanum hexaborides etc. The insulated support 104 surrounding the filament 101 and the cathode 102 is equivalent to the housing of electron transmitting unit 1 and are made of insulated material, typically ceramic. The filament lead 105 and the grid lead 108 extend outside the lead end of the electron transmitting unit 1 through the insulated support 104. Between the filament lead 105, the grid lead 108 and the insulated support 104 is a seal structure. Grid 103 is located at the upper end of the insulated support 104 (namely, it is located at the opening of the insulated support 104) opposing the cathode 102. The grid 103 is aligned with the center of the cathode 102 vertically. The grid 103 includes a grid frame 106, a grid mesh 107, a grid lead 108, all of which are made of metal. Normally, the grid frame 106 is made of stainless steel material, grid mesh 107 molybdenum material, and grid lead 108 stainless steel material or Kovar material.

What's more, in particular, with respect to the structure of the grid 103, the main body thereof is a piece of metal plate (e.g. stainless steel material), that is the grid frame 106. An opening is provided at the center of the grid frame 106, the shape thereof can be square or circular etc. A wire mesh (e.g. molybdenum material) is fixed at the position of opening, namely the grid mesh 107. Moreover, a lead (e.g. stainless steel material), namely the grid lead 108, extends from somewhere of the metal plate such that the grid 103 can be connected to an electric potential. Additionally, the grid 103 is positioned right above the cathode 102. The center of the above-mentioned opening of the grid is aligned with the center of the cathode 102 (namely in a vertical line longitudinally). The shape of the opening is corresponding to that of the cathode 102. However, the opening is smaller than the area of cathode 102. However, the structure of the grid 103 is not limited to those described above as long as the electron beam current is able to pass the grid 103. In addition, the grid 103 is fixed with respect to cathode 102 by the insulated support 104.

What's more, in particular, with respect to the structure of the connecting fastener 109, preferably, the main body thereof is a circular knife edge flange with opening provided in the center. The shape of the opening may be square or circular etc. Seal connection can be provided at the opening and the outer edge of the lower end of the insulated support 104, for example, welding connection. Screw holes are formed at the outer edge of the knife edge flange. The electron transmitting unit 1 can be fixed to the walls of the vacuum box 3 by bolted connection. A vacuum seal connection is formed between the knife edge and the wall of the vacuum box 3. This is a flexible structure easy for disassemble where certain one of multiple electron transmitting units 1 breaks down it can be replaced easily. It should be noted that the connecting fastener 109 functions to achieve the seal connection between the insulated support 104 and the vacuum box 3 and various ways may be employed, for example, transition welding by metal flange, or glass high temperature melting seal connection, or welding to the metal after ceramic metallizing etc.

Figure 4:
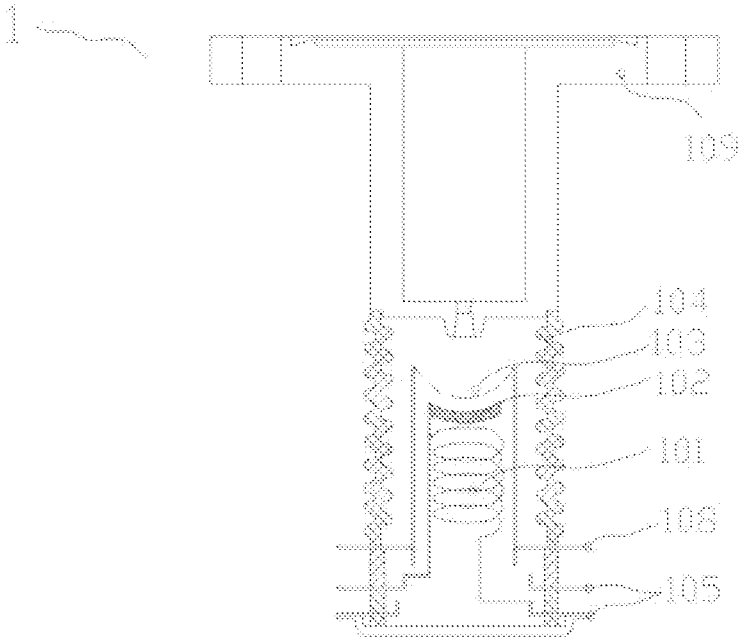
FIG. 4 depicts the schematic view of the structure of another electron transmitting unit in the present application.

A specific structure of another electron transmitting unit 1 is shown in FIG. 4. The electron transmitting unit 1 includes a filament 101, a cathode 102, a grid 103, an insulated support 104, a filament lead 105, a grid lead 108 as well as a connecting fastener 109. The cathode 102 is connected to the filament 101. The grid 103 is located right above the cathode 102 with a configuration identical with that of the cathode 102 and adjacent to the upper surface of the cathode 102. The insulated support 104 encloses the filament 101 and the cathode 102. The filament lead 105 extending outside both ends of the filament 101 and the grid lead 108 extending from the grid 103 are extended to the outside of the electron transmitting unit 1 though the insulated supporting 104. Between the filament lead 105, the grid lead 108 and the insulated support 104 is a seal structure.

Figure 5:
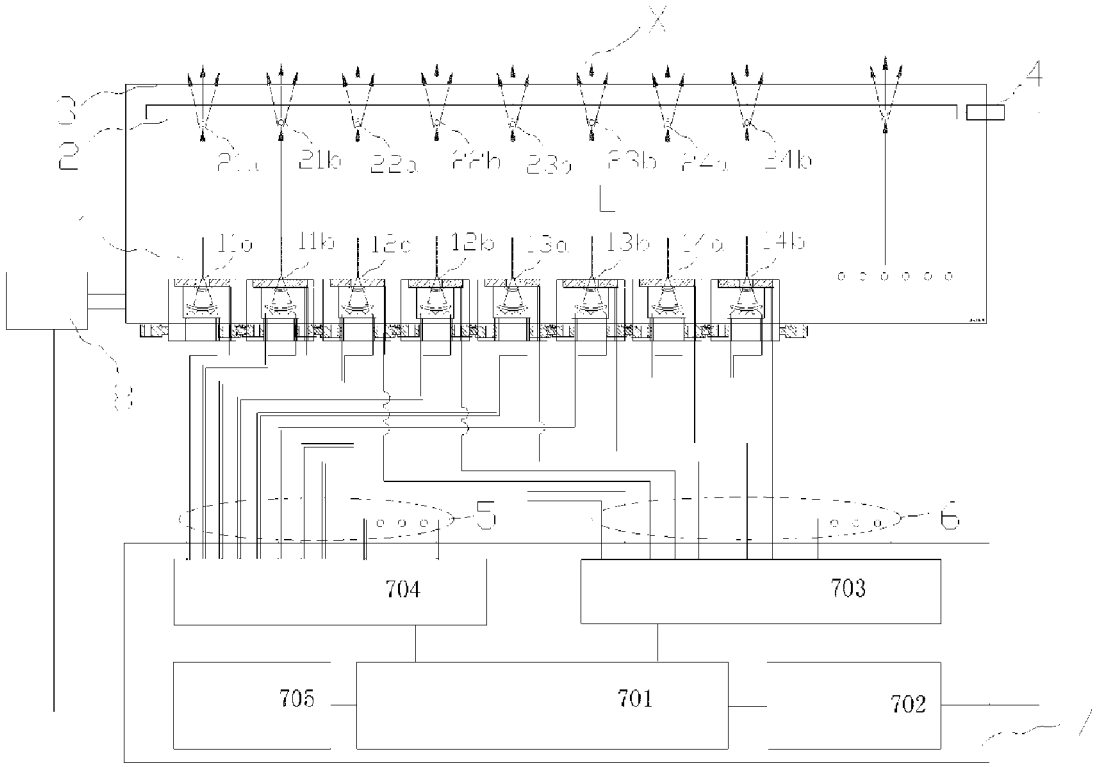
FIG. 5 depicts a view of the structure of a two dimensional distributed x-ray apparatus in the present application.

FIG. 5 shows an overall structure of a two dimensional array distributed x-ray apparatus. The vacuum box 3 is a housing of a cavity with its periphery sealed and the interior thereof is high vacuum. The electron transmitting units 1 for generating the electron beam current as required are installed on the wall of the vacuum box 3. The anode 2 for forming parallel high voltage electric field and generating x-rays is installed inside the vacuum box 3. The high voltage power supply connecting means 4 for connecting the anode 2 to the cable of the high voltage power supply 702 is installed on the side wall at the end adjacent to the anode 2. The filament power supply connecting means 5 for connecting the filament lead 105 to the filament power supply 704 are normally a plurality of multi-core cables with connectors at both ends. The connecting means of grid-controlled apparatus 6 for connecting the grid lead 108 of the electron transmitting unit 1 to the grid-controlled apparatus 703 are typically a plurality of coaxial cable with connectors at both ends. In addition, the two dimensional array distributed x-ray apparatus according to the present application further includes a vacuum means 8 working under the effect of the vacuum power supply 705 for maintaining the high vacuum in the vacuum box 3 and installed on the side wall of the vacuum box 3.

In addition, the power supply and control system 7 includes a control system 701, a high voltage power supply 702, a grid-controlled apparatus 703, a filament power supply 704, a vacuum power supply 705 etc. The High voltage power supply 702 is connected to the anode 2 by the high voltage power supply connecting means 4 installed on the wall of the vacuum box 3. The grid-controlled apparatus 703 is connected to each grid lead 108 respectively by the connecting means of grid-controlled apparatus 6. Normally, the number of electron transmitting units 1 is same as that of independent grid leads 108, and the number of the output lines of the grid-controlled apparatus 703 is same as that of the number of grid leads 108. The filament power supply 704 is connected to each filament lead 105 by the filament power supply connecting means 5 and usually has independent filament leads, the number of which is same as that of the electron transmitting units 1 (namely, as mentioned above, each electron transmitting unit has a set of filament leads, 2 filament leads, for connected to both ends of the filament). The number of the output loop of the filament power supply 704 is same as that of the filament leads 105. The vacuum power supply 705 is connected to the vacuum means 8. The operating condition of the high voltage power supply 702, the grid-controlled apparatus 703, the filament power supply 704, and the vacuum power supply 705 etc may be controlled and managed synthetically by the control system 701.

Figure 6:
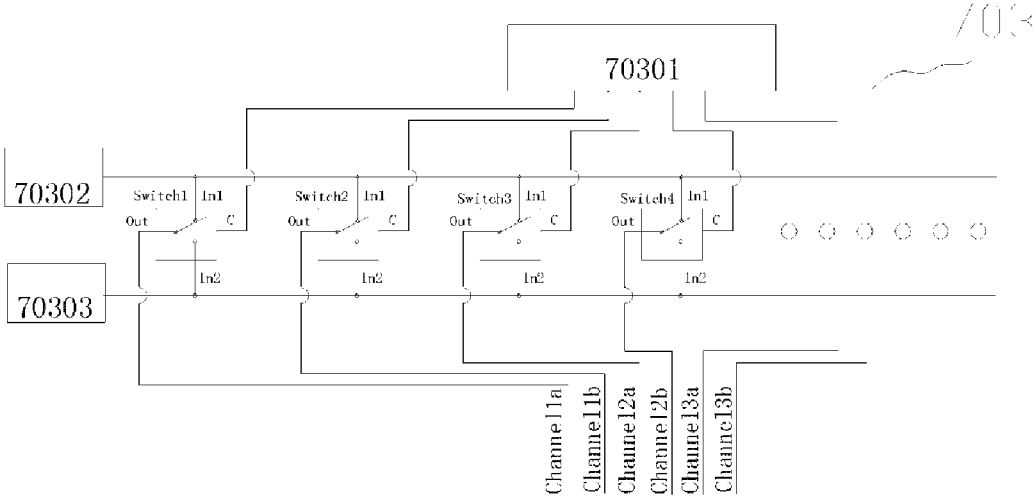
FIG. 6 depicts a schematic view of the structure of the grid-controlled apparatus in the present application.

In addition, as shown in FIG. 6, the grid-controlled apparatus 703 includes a controller 70301, a negative high voltage module 70302, a positive high voltage module 70303 and a plurality of high voltage switch elements switch 1, switch 2, switch 3, and switch 4 . . . . Each of the plurality of high voltage switch elements at least includes a control end (C), two input ends (In1 and In2), an output end (Out). The withstand voltage between each end must be larger than the maximum voltage formed by the negative high voltage module 70302 and the positive high voltage module 70303 (that is to say, if the output of negative high voltage is −500V and the output of the positive high voltage is +2000V, the withstand voltage between each end must be larger than 2500V at least). The controller 70301 has independently multipath output, and each path is connected to the control end of a high voltage switch element. The negative high voltage module 70302 provides a stable negative high voltage, typically negative hundreds of volts. The range of negative high voltage can be 0V to −10 kV, and −500V is preferred. The negative high voltage is connected to one input end of each high voltage switch element. In addition, the positive high voltage module 70303 provides a stable positive high voltage, typically positive thousands of volts. The range of positive high voltage can be 0V to +10 kV, and +2000V is preferred. The positive high voltage is connected to the other input end of each high voltage switch element. The output end of each high voltage switch element is connected to control signal output channel channel 11*a*, channel 11*b*, channel 12*a*, channel 12*b*, channel 13*a*, channel 13*b* . . . , thus forming multipath to output control signal. Controller 70301 controls the operating state of each high voltage switch element such that the control signal of each output channel is negative high voltage or positive high voltage.

In addition, the power supply and control system 7 can adjust the current magnitude of each output loop of filament power supply 704 under different using condition so as to adjust the heating temperature that each heating filament 101 applies to the cathode 102 for changing the magnitude of transmitting current of each electron transmitting unit 1 and finally adjusting the intensity of x-ray transmitted each time. In addition, the intensity of the positive high voltage control signal for each output channel of the grid-controlled apparatus 703 can be adjusted so as to changing the magnitude of transmitting current of each electron transmitting unit 1 and finally adjusting the intensity of x-ray transmitted each time. Additional, the operating timing sequence and combining operating mode of each electron transmitting unit 1 can be programmed to realize flexible control.

Figure 7:
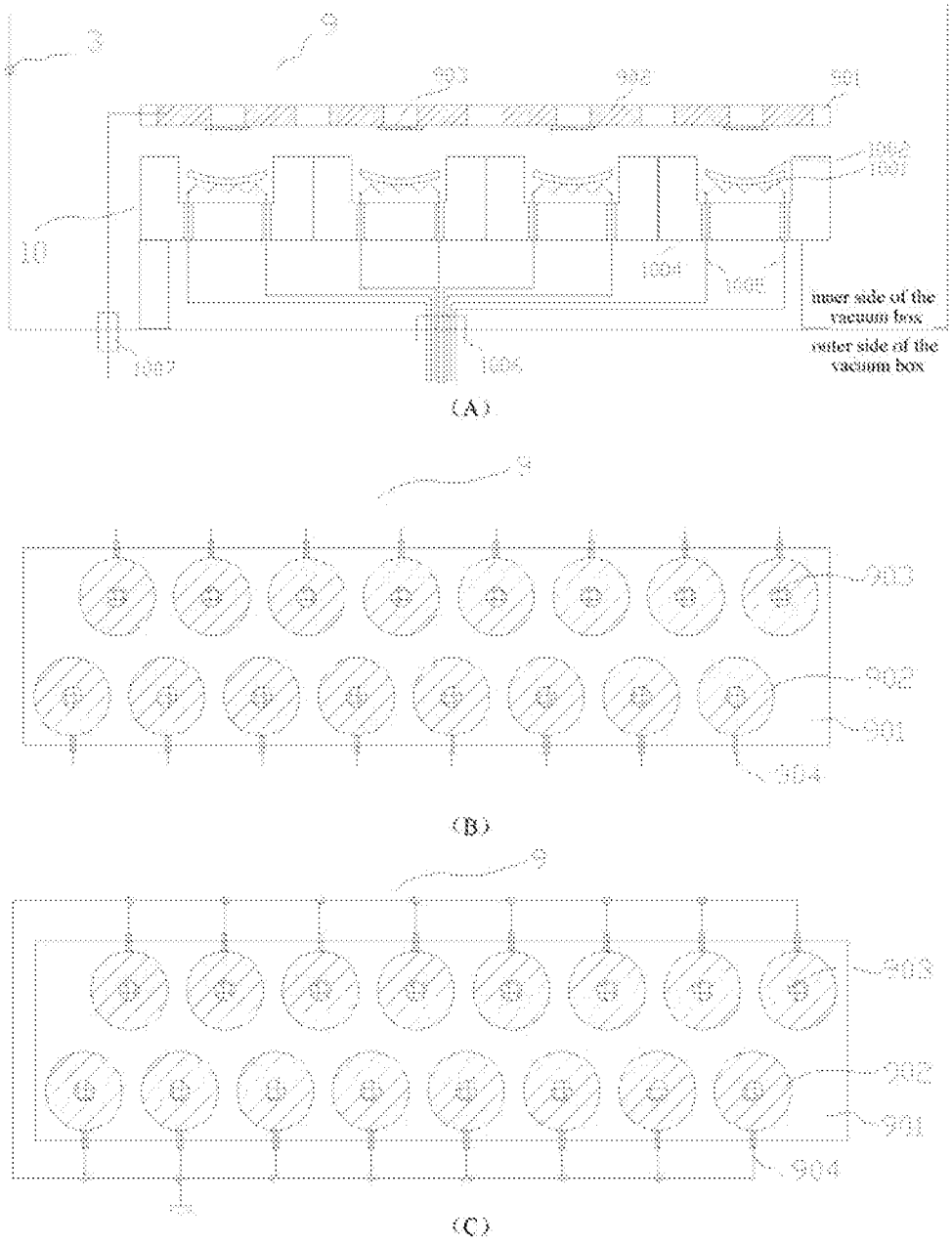
FIG. 7 depicts a schematic view of the array of the electron transmitting unit with the grid and the cathode separated, wherein (A) is the side view, (B) is the top view in which each grid in a mode of independent control, and (C) is a top view in which each grid is interconnected and in a mode of cathode control.

It should be noted that in the two dimensional distributed x-ray apparatus of the present application, the electron transmitting unit can be a structure with the grid and the cathode separated. FIG. 7 shows an array of the electron transmitting units with the grid and the cathode separated. In FIG. 7, the flat grid 9 is composed of an insulated frame plate 901, a grid plate 902, a grid mesh 903 and grid lead 904. As shown in the figure, the grid plate 902 is disposed on the insulated frame plate 901 and the grid mesh 903 is disposed at the position where the opening is formed on the grid plate 902. The grid leads 904 extend from the grid plate 902. An array of the cathodes 10 is composed of multiple cathodes structure arranged tightly. Each cathode structure is composed of a filament 1001, a cathode 1002, an insulated support 1004. The flat grid 9 is located above the cathode array 10 and the distance between the flat grid 9 and the cathode array 10 is very small, typically a few millimeters, e.g. 3 mm. The grid structure composed of the grid plate 902, the grid mesh 903, the grid lead 904 is in one-to-one correspondence with the cathode structure. In addition, observed from the vertical direction, the center of the circle of each grid mesh 903 is coincided with the center of the circle of each cathode 1002. The flat grid 9 and the array of the cathodes 10 are located within the vacuum box 3. The filament lead 1005 and the grid lead 904 extend outside the vacuum box by the transition terminal of the filament lead 1006 and the transition terminal of the grid lead 1007 arranged on the wall of the vacuum box 3.

In addition, as shown in FIG. 7(B), in the present application, the grid structure can be a structure in which each grid lead extends independently and is controlled by the grid-controlled apparatus independently. Each cathode 1002 of the cathode array 10 may be in the same electric potential, e.g. in ground connection. Each grid shifts between the state of hundreds of volts and the state of thousands of volts, for example between −500V to +2000V, so as to control the operating state of each electron transmitting unit. For example, the voltage of a certain grid is −500V at certain moment. The electric field between this grid and the corresponding cathode is a negative electric field and the electrons transmitted from the cathode are limited to the surface of the cathode. At the next moment, the voltage of the grid changes to +2000V, the electric field between this grid and the corresponding cathode changes to a positive electric field and the electrons transmitted from the cathode moves towards the grid and through the grid mesh into the accelerated electric field between the grid and the anode. The electrons are accelerated, and finally bombard the anode generating the x-rays at the corresponding position of the target.

In addition, as shown in FIG. 7C, the grid can be the parallel connection of each grid lead in the same electric potential. The operating state of each electron transmitting unit is controlled by the filament power supply. For example, the voltage of all grids are −500V and each filament of the cathode extends independently. The voltage difference between the two ends of each filament of cathode is constant. The overall voltage of each cathode shifts between the state of 0V and the state of −2500V. At a certain moment, the cathode is in the electric potential of 0V, the electric field between the grid and the cathode is negative and the electrons transmitted from the cathode are limited to the surface of the cathode. At the next moment, the voltage of the cathode changed to −2500V and the electric field between the grid and the corresponding cathode changed to positive. The electrons transmitted from the cathode move toward the grid through the grid mesh into the accelerated electric field between the grid and the anode. The electrons are accelerated, and finally bombard the target generating the x-rays at the corresponding position of the target.

Figure 8:
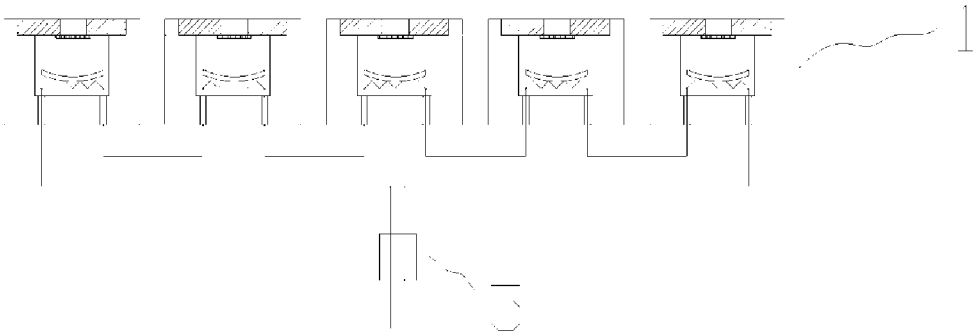
FIG. 8 depicts the distributed x-ray apparatus in the present application in which the filament is connected in series.

It should be noted that in the two dimensional distributed x-rays apparatus of this disclosure, the filament lead of each electron transmitting unit can be each output end connected to the filament power supply respectively and independently or one output end connected to the filament power supply after a series connection. FIG. 8 shows a schematic view in which the filament lead of the electron transmitting unit is connected to the filament power supply in series. In the system where the filament leads of electron transmitting unit are connected in series, typically the cathodes are in the same electric potential. Each grid lead should extend independently and the operating state of the electron transmitting unit is controlled by the grid-controlled apparatus.

Figure 9:
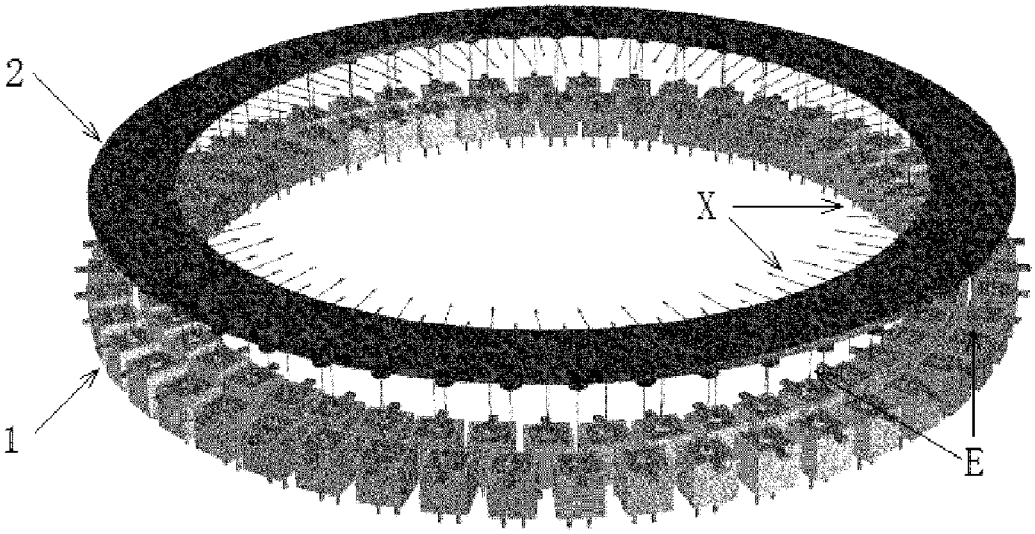
FIG. 9 depicts a schematic view of the configuration of electron transmitting unit and the anode inside the arc-shaped two dimensional distributed x-ray apparatus in the present application.

It should be noted that in the two dimensional distributed x-ray apparatus of this disclosure, the electron transmitting units can be in linear arrangement or cambered arrangement so as to meet different application requirements. FIG. 9 shows a view of the arrangement effect of the electron transmitting unit and the anode of the arc two dimensional distributed x-ray apparatus of the present application. Multiple electron transmitting units 1 are arranged in a plane in an inner track and an outer track. The size of arc arranged can be set as needed flexibly being a complete circumference or a section of the circumference. The anode 2 is arranged above the electron transmitting unit 1, and the plane of the anode 2 is parallel to the plane in which the electron transmitting units 1 are arranged. The targets 202 on the anode 2 are in one-to-one correspondence to the position of the electron transmitting units 1, and the inclination of the vertex angle of the targets 202 are unified to be directed to the center of the circular array. The electron beam current is transmitted from the upper surface of the electron transmitting unit 1 and accelerated by the high voltage electric field between the anode 2 and the electron transmitting unit 1, and finally bombards the target 202 forming an array of x-ray target spots in arc arrangement on the anode 2. The transmitting direction of useful x-ray is directed to the center of the arc. With regards to the vacuum box of the arc two dimensional distributed x-ray apparatus is a ring-shaped configuration corresponding to that of the electron transmitting unit 1 and the shape of anode 2 inside it. The length can be a whole or a section of the periphery. The x-rays transmitted by the arc distributed x-ray apparatus are directed to the center of the arc and are able to be applied to the occasion that needs the source of ray to be in a circular arrangement.

It should be noted that in the two dimensional distributed x-ray apparatus of the disclosure, the array of the electron transmitting unit can be two rows or multiple rows.

In addition, it should be noted that in the two dimensional distributed x-ray apparatus of the disclosure, the target of the anode can be frustum of a cone, or a cylinder, or a quadrate platform, or multi-edge platform as well as other polygon protrusions or irregular protrusion etc.

In addition, it should be noted that in the two dimensional distributed x-ray apparatus of the disclosure, the upper surface of the target of the anode can be a plane, a slope, a spherical surface or other irregular surface.

In addition, it should be noted that in the two dimensional distributed x-ray apparatus of the disclosure, the configuration of the two dimensional array may extends in line in both directions, or may extends in line in one direction and extends in an arc in the other direction, or may extends in line in one direction and extends in segmented line in the other direction, as well as extends in line in one direction and extends in a segmented arc in the other direction or other ways in combination.

In addition, it should be noted that in the two dimensional distributed x-ray apparatus of the disclosure, the configuration of the two dimensional array may space uniformly in both directions, or may space uniformly in each direction but the spaces of two directions are different, or may space uniformly in one direction but non-uniformly in the other direction, or may space uniformly in neither direction.

Embodiments (System Configuration)

As shown in FIG. 1-6, the two dimensional distributed x-ray apparatus of this disclosure includes a plurality of electron transmitting units 1, an anode 2, a vacuum box 3, a high voltage power supply connecting means 4, a filament power supply connecting means 5, a connecting means of grid-controlled apparatus 6, a vacuum means 8 and a power supply and control system 7. The plurality of electron transmitting units 1 are installed in a plane in a two dimensional array and installed on the wall of the vacuum box 3. Each electron transmitting unit 1 is independent to each other. The anode 2 in a shape of strip is installed above the electron transmitting unit 1 at the upper end inside the vacuum box 3 and parallel to the plane of the electron transmitting unit 1. The electron transmitting unit 1 includes a filament 101, a cathode 102, a grid 103, an insulated support 104, a filament lead 105 and a connecting fastener 109. In addition, the grid 103 is composed of a grid frame 106, a grid mesh 107 and a grid lead 108. In addition, the anode 2 is composed of the anode plate 201 and the target 202. The target 202 is installed on the anode plate 201 and the position thereof is disposed in correspondence with the position of the electron transmitting unit 1. The direction of the slope of the upper surface of all targets 202 is consistent and is the direction along which useful x-rays are transmitted. The high voltage power supply connecting means 4 is installed to the vacuum box 3 at the end adjacent to the anode 2, the interior thereof is connected to the anode 2 and the exterior thereof is connected to the high voltage power supply 702. The filament lead 105 of each electron transmitting unit 1 is connected to the filament power supply 704 by the filament power supply connecting means 5. The filament power supply connecting means 5 is the two-core cable with connectors at both ends. The grid lead 108 of each electron transmitting unit 1 is connected to the grid-controlled apparatus 703 by the connecting means of grid-controlled apparatus 6. The connecting means of grid-controlled apparatus 6 are multiple high voltage coaxial cables with connectors at both ends. The vacuum means 8 is installed on the side wall of the vacuum box 3. The power supply and control system 7 includes multiple modules including a control system 701, a high voltage power supply 702, a grid-controlled apparatus 703, a filament power supply 704, a vacuum power supply 705 etc., those of which are connected to the components of the system including the filaments 101 of multiple electron transmitting units 1, grid 103 and anode 2, vacuum means 8 etc by power cable and controlling cable.

(Operating Principle)

In the two dimensional distributed x-ray apparatus of this disclosure, the power supply and control system 7 controls the filament power supply 704, the grid-controlled apparatus 703 and the high voltage power supply 702. Under the effect of the filament power supply 704, the cathode 102 is heat to 1000-2000° C. by the filament 101 and a large number of electrons are generated at the surface of the cathode 102. Each grid 103 is in the negative voltage, e.g. −500V, due to the grid-controlled apparatus 703. A negative electric field is formed between the grid 103 and the cathode 102 of each electron transmitting unit 1 and the electrons are limited to the surface of the cathode 102. Anode 2 is in a much high positive voltage, e.g. +180 KV, due to the high voltage 702, and a positive accelerating electric field is formed between the electron transmitting unit 1 and the anode 2. In the case that needs generation of x-ray, the output of a certain path of the grid-controlled apparatus 703 is converted from negative voltage to positive voltage by the power supply and control system 7 following instruction or preset program. The output signal of each path is converted in accordance with the time sequence, for example, the voltage of the output channel 1*a* of the grid-controlled apparatus 703 is changed from −500V to +2000V at the moment 1. In the corresponding electron transmitting unit 11*a*, the electric field between the grid 103 and the cathode 102 is changed to positive. The electrons move to the grid 103 from the surface of the cathode 102 and enter into the positive electric field between the electron transmitting unit 11*a* and anode 2 through the grid mesh 107. Thus, the electrons are accelerated and changed to high energy, and finally bombard the target 21*a* transmitting the x-rays at the position of target 21*a*. The voltage of the output channel 1*b* of the grid-controlled apparatus 703 is changed from −500V to +2000V at the moment 2. The corresponding electron transmitting unit 11*b* transmits electrons, thus bombarding target 21*b* and the x-rays are transmitted at the position of target 21*b*. The voltage of the output channel 2*a* of the grid-controlled apparatus 703 is changed from −500V to +2000V at the moment 3. The corresponding electron transmitting unit 12*a* transmits electrons, thus bombarding the target 22*a* and the x-rays are transmitted at the position of the target 22*a*. The voltage of the output channel 2*b* of the grid-controlled apparatus 703 is changed from −500V to +2000V at the moment 4. The corresponding electron transmitting unit 12*b* transmits electrons, thus bombarding target 22*b* and the x-rays are transmitted at the position of target 22*b*. The rest can be done in the same manner. Then x-rays are generated at the target 23*a*, and than x-rays are generated at the target 23*b* . . . and that cycle repeats. Therefore, the power supply and control system 7 makes each electron transmitting unit 1 work alternately to transmit electron beam following a predetermined time sequence and generate x-rays alternately at different positions of targets so as to become the distributed x-ray source.

The gas generated when the target 202 is bombarded by the electron beam current is drawn out by the vacuum means 8 in real time, and a high vacuum is maintained in the vacuum box 3, thus facilitating the stable operation for a long time. In addition to control each power supply to drive each component working coordinately following the preset program, the power supply and control system 7 also can receive external command by the communication interface and the human-computer interface and modify and set key parameters of the system as well as update the program the adjust automatic control.

In addition, the two dimensional array distributed x-ray light source of this disclosure can be applied to CT device so as to obtain a CT device of good stability, excellent reliability and high efficiency for inspection.

(Effects)

The disclosure provides a two dimensional array distributed x-ray apparatus generating x-rays changing the focus position periodically in a predetermined sequence in a light source device. By employing the thermionic cathode, the electron transmitting unit of this disclosure has the advantages of large transmitting current and long service life. It is easy and flexible to control the operating state of each electron transmitting unit by grid control or cathode control. The overheat of the anode is remitted by employing the design of big anode thus forming a focusing effect of the target and reducing the cost. By the two dimensional array configuration of the electron transmitting unit and the corresponding targets, the x-rays are transmitted in parallel to the plane of the array. Observed from the direction along which the x-rays are transmitted, the spaces between the target spots are decreased and the density of the target spots is increased. The electron transmitting units can be in a flat two dimensional configuration, or in an arc two dimensional configuration, rendering the overall to be a linear distributed x-ray apparatus or an annular distributed x-ray apparatus, so as to have flexible applications.

In addition, applying the two dimensional array distributed x-ray light source to the CT device, multiple visual angles can be generated without moving the light source, and therefore the movement of slip ring could be omitted. This contributes to simplify the structure, enhance the stability and reliability of the system, hence increasing the efficiency of inspection.

Embodiments have been disclosed above for the purpose of illustration but are not limited thereto. It should be appreciated that various modifications and combination are possible without departing from the scope and spirit of the accompanying claims.

LIST OF REFERENCE NUMBERS

101: filament;
102: cathode;
103: grid;
104: insulated support;
105: filament lead;
106: grid frame;
107: grid mesh;
108: grid lead;
109: connecting fastener;
201: anode plate;
202: target;
E: electronic beam current;
X: x-ray;
1: electron transmitting unit
2: anode;
3: vacuum box;
4: high voltage power supply connecting means;
5: filament power supply connecting means;
6: connecting means of the grid-controlled apparatus;
7: power supply and control system;
8: vacuum means;
9: flat grid
901: insulated frame plate;
902: grid plate;
903: grid mesh;
904: grid lead;
10: array of the cathodes
1001: filament;
1002: cathode;
1004: insulated support;
1005: filament lead;
1006: transition terminal of the filament lead;
1007: transition terminal of the grid lead;

The invention claimed is:

1. An x-ray apparatus, comprising:

a vacuum box which is sealed at its periphery, wherein the interior thereof is in vacuum;

a plurality of electron transmitting units arranged in one plane in a two dimensional array on a wall of the vacuum box; and an anode arranged in parallel with the plane of the plurality of electron transmitting units in the vacuum box to allow electrons generated by the plurality of electron transmitting units to bombard a plurality of targets on the anode to generate x-rays, wherein the plurality of electron transmitting units is disposed at least partially outside the vacuum box.

2. The x-ray apparatus according to claim 1, further comprising:

a power supply and control system having a high voltage power supply connected to the anode;

a filament power supply connected to each of the plurality of the electron transmitting units;

a grid-controlled apparatus connected to each of the plurality of electron transmitting units; and a control system for controlling each power supply, wherein the anode comprises:

an anode plate made of metal and parallel to an upper surface of the plurality of electron transmitting units; and the plurality of targets arranged on the anode plate and disposed corresponding to positions of the plurality of electron transmitting units, wherein a bottom surface of each of the targets is connected to the anode plate, and an upper surface of each of the targets has a predetermined angle with the anode plate.

3. The x-ray apparatus according to claim 2, wherein each of the targets is a spherical structure.

4. The x-ray apparatus according to claim 2, wherein the upper surface of each of the targets is a plane, or a slope, or a spherical surface or other irregular surface.

5. The x-ray apparatus according to claim 2, wherein each of the plurality of electron transmitting units comprises:

a filament;

a cathode connected to the filament;

an insulated support having an opening and enclosing the filament and the cathode;

a filament lead extending from opposing ends of the filament;

a grid arranged above the cathode opposing the cathode; and a connecting fastener connected to the insulated support, wherein, each of the plurality of electron transmitting units is installed on the wall of the vacuum box forming a vacuum seal connection, wherein the grid has:

a grid frame which is made of metal and provided with an opening in the center;

a grid mesh which is made of metal and fixed at a position of the opening of the grid frame; and a grid lead, extending from the grid frame, wherein the filament leads are connected to the filament power supply and the grid lead is connected to the grid-controlled apparatus, and wherein the filament leads and the grid lead extend to the outside of each of the plurality of electron transmitting units through the insulated support.

6. The x-ray apparatus according to claim 5, wherein the connecting fastener is connected to an outer edge of a lower end of the insulated support, and a cathode end of each of the plurality of electron transmitting units is located inside the vacuum box while a lead end of each of the plurality of electron transmitting units is located outside the vacuum box.

7. The x-ray apparatus according to claim 5, wherein the connecting fastener is connected to an upper end of the insulated support.

8. The x-ray apparatus according to claim 2, further comprising:

a high voltage power supply connecting means connecting the anode to the high voltage power supply and installed to a side wall of the vacuum box adjacent to the anode;

a filament power supply connecting means for connecting a filament to the filament power supply;

a connecting means of the grid-controlled apparatus for connecting a grid of each of the plurality of electron transmitting units to the grid-controlled apparatus;

a vacuum power supply included in the power supply and control system; and a vacuum means installed on a side wall of the vacuum box maintaining vacuum in the vacuum box utilizing the vacuum power supply.

9. The x-ray apparatus according to claim 2, wherein:

the grid-controlled apparatus includes a controller, a negative high voltage module, a positive high voltage module and a plurality of high voltage switch elements, each of the plurality of high voltage switch elements at least includes a control end, two input ends, and an output end, a withstand voltage between the control end and the output end at least being larger than a maximum voltage formed by the negative high voltage module and the positive high voltage module, the negative high voltage module is configured to provide a stable negative high voltage to one input end of each of the plurality of high voltage switch elements, the positive high voltage module is configured to provide a stable positive high voltage to the other input end of each of the plurality of high voltage switch elements, the controller is configured to independently control each of the plurality of high voltage switch elements, the grid-controlled apparatus further has a plurality of control signal output channels, and one output end of the high voltage switch elements is connected to one of the control signal output channels.

10. The x-ray apparatus according to claim 1, wherein each of the plurality of electron transmitting units comprises:

a flat grid composed of an insulated frame plate, a grid plate, a grid mesh and a grid lead; and an array of cathodes composed of multiple cathodes structure arranged tightly, wherein each cathode structure is composed of a filament, a cathode connected to the filament, a filament lead extended from opposing ends of the filament and an insulated support enclosing the filament and the cathode, wherein the grid plate is provided to the insulated frame plate and the grid mesh is disposed at a position on which an opening of the grid plate is formed, wherein the grid lead extends from the grid plate and the flat grid is located above the cathode array, and in a vertical direction, the center of each grid mesh is coincided with the center of each cathode of the cathode array, wherein the flat grid and the cathode array are located in the vacuum box, and wherein the filament lead and the grid lead extend to the outside of the vacuum box by a transition terminal of the filament lead and a transition terminal of the grid lead arranged on the wall of the vacuum box.

11. The x-ray apparatus according to claim 1, wherein the array of the plurality of the electron transmitting units is lines in both directions, or a line in one direction and a segmented line in the other direction.

12. The x-ray apparatus according to claim 1, wherein the array of the plurality of the electron transmitting units is arranged in a straight line in one direction and in an arc in the other direction.

13. A computed tomography device, comprising the x-ray apparatus according to claim 1.

* * * * *